United States Patent [19]

Allison

[11] 4,406,469

[45] Sep. 27, 1983

[54] PLASTICALLY DEFORMABLE CONDUIT SEAL FOR SUBTERRANEAN WELLS

[75] Inventor: James H. Allison, Houston, Tex.

[73] Assignee: Baker International Corporation, Orange, Calif.

[21] Appl. No.: 304,423

[22] Filed: Sep. 21, 1981

[51] Int. Cl.[3] ..... F16J 15/18

[52] U.S. Cl. ..... 277/123; 277/188 A; 277/30; 277/DIG. 6

[58] Field of Search ..... 277/123-125, 277/188 R, 188 A, DIG. 6, 30, 31

[56] References Cited

U.S. PATENT DOCUMENTS

| | | | |
|---|---|---|---|
| 2,188,957 | 2/1940 | Pfauser | 277/124 X |
| 3,306,620 | 2/1967 | Taschenberg | 277/188 R X |
| 3,351,350 | 11/1967 | Shepler | 277/188 R X |
| 3,467,394 | 9/1969 | Bryant | 277/1 |
| 3,627,337 | 12/1971 | Pippert | 277/233 |
| 4,050,701 | 9/1977 | Webb | 277/125 |
| 4,234,197 | 11/1980 | Amancharla et al. | 277/125 X |

FOREIGN PATENT DOCUMENTS

| | | | |
|---|---|---|---|
| 2412698 | 9/1975 | Fed. Rep. of Germany | 277/124 |
| 2753682 | 6/1979 | Fed. Rep. of Germany | 277/124 |

OTHER PUBLICATIONS

Burley, et al., "Recent Developments In Packer Seal Systems for Sour Oil and Gas Wells", (SPE Report #6762, 1977), 7 pp.

*Primary Examiner*—Robert S. Ward, Jr.
*Attorney, Agent, or Firm*—Norvell & Associates

[57] ABSTRACT

A self-energizing seal system employing plastically deformable nonelastomeric elements to establish sealing integrity between concentric, relatively movable tubular conduits is disclosed. The primary sealing element comprises a chevron-shaped thermoplastic virgin polytetrafluoroethylene member. A plurality of back-to-back primary sealing elements are employed, thus creating a relatively frictionless interface along which radial expansion of the chevron-shaped members can occur. Annular back up members of polyphenylene sulfide and glass-filled polytetrafluoroethylene are used to inhibit axial extrusion of the chevron-shaped sealing members during radial expansion thus promoting sealing integrity.

19 Claims, 7 Drawing Figures

PLASTICALLY DEFORMABLE CONDUIT SEAL FOR SUBTERRANEAN WELLS

BACKGROUND OF THE INVENTION

1. Field of the Invention

This invention relates to a seal system designed for particular use in the completion and production operations of oil and gas wells wherein the seal comprises a plurality of plastically deformable members.

2. Description of the Prior Art

Petroleum reserves found in relatively deep wells and in relatively hostile environments have resulted in attendant problems due to sour formation fluid, high pressure and increasingly higher temperatures. Under these conditions, a reliable downhole seal system must function in hot, high pressure, sour gas environments, including the presence of corrosive materials such as hydrogen sulfide. These considerations, especially the chemical environment in which the seal must operate, may limit the choice of packing materials to a plastically deformable or nonelastomeric element having relatively low resiliency and high permanent set, particularly when sealing against extremely high pressures. Polytetrafluoroethylene, commonly referred to under the DuPont trademark as "Teflon", is one material having the necessary chemical resistance, but also has relatively low resiliency and high permanent set. Teflon will, therefore, not have the flexible characteristics which make elastomers, including perfluoroelastomers, a highly attractive sealing material for use in certain hostile environments.

Polytetrafluoroethylene members have been used as sealing or packing elements in both subterranean oil well applications and for providing sealing engagement to cylindrical members in other applications. For example, Teflon packing elements have been utilized for external packer-to-casing seal systems where the packing element is subjected to compressive preloading which energizes the element and forces it radially outward to establish sealing engagement with the casing. Unlike these Teflon external packer-to-casing seal elements, the present invention employs self-energizing chevon-shaped Telfon sealing elements. The distinction between a preloaded sealing element and a self energizing chevron ring sealing element is demonstrated by one patent intended for use in a non oil well environment. U.S. Pat. No. 3,351,350 depicts a high pressure rod seal employing a preloaded polytetrafluoroethylene ring used independently of a separate chevron ring made from neoprene impregnated duck fabric.

The prior art use of polytetrafluoroethylene in a chevron-shaped configuration illustrates the overriding need of providing means to prevent axial extrusion of the chevron-shaped Teflon members and to enhance the elastic memory of Teflon elements. The use of a plurality of chevron-shaped glass-filled Teflon members in combination with a two-piece titanium metal-to-metal anti-extrusion ring was reported in Report No. SPE 6762 of the 52nd Annual Fall Technical Conference and Exhibition of the Society of Petroleum Engineers on Oct. 9th through the 12th, 1977. Satisfactory performance of the chevron-shaped Teflon members was achieved only in conjunction with the two-piece metal-to-metal anti-extrusion ring. The alternative problem of imparting elastic memory to the Teflon member is disclosed in U.S. Pat. No. 3,467,394. That patent discloses a packing assembly employing Vee-shaped polytetrafluoroethylene sealing elements interspersed with relatively rigid packing rings. The packing rings are made from flexible materials, including various flexible types of elastomers and plastics which are used to impart their memory to the Teflon sealing rings. A packing ring comprising alternating rings of thermosetting material and thermoplastic material, such as Teflon, is disclosed in U.S. Pat. No. 3,627,337. The more or less rigid nonflowing thermosetting materials were found to restrain the thermoplastic components against excessive flow.

Despite its physical limitations, Teflon would be a desirable sealing element for use in an oil well packing element system if only because of its resistance to chemicals encountered during production of fluids in an oil or gas well. The present invention provides such a means for utilizing chevron-shaped self-energizing Teflon sealing elements to provide an acceptable seal at high temperature and pressure. Virgin polytetrafluoroethylene seal elements are used in conjunction with twenty-five percent glass-filled polytetrafluoroethylene back up elements and polyphenylene sulfide back up elements, both of which have a greater resistance to extrusion than virgin polytetrafluoroethylene. Polyphenylene sulfide is commonly referred to as "Ryton", a trademark of Phillips Petroleum Corporation. Glass-filled Teflon back up members and Ryton back up members have been used in conjunction with perfluoroelastomer elements, commonly referred to under the DuPont trademark "Kalrez", to provide an unusually effective packing element for high temperature and high pressure environments. The chemical resistance of Teflon is, however, generally better than that of Kalrez, especially to certain amine corrosion inhibitors into producing wells. U.S. Pat. No. 4,234,197 discloses the use of "Kalrez" elements with Ryton and glass-filled Teflon members.

Teflon has also been used in conjunction with Ryton to form a single sealing element. The use of polyphenylene sulfide seals impregnated with Teflon elements is disclosed in U.S. Pat. No. 4,050,701.

The seal system provided by the present invention employs only plastically deformable members, such as Teflon, to establish a seal between concentric conduits in a subterreanean oil well. Elastomeric elements exhibit substantially complete memory while plastic elements do not. By replacing the elastomeric sealing elements with a nonelastomer, the temperature range over which the seal system performs adequately is somewhat less than can be achieved with elastomeric systems. The use of a nonelastomer as the primary sealing element limits the lower temperature at which an acceptable seal can be maintained. After the thermoplastic Teflon material is initially heated to some higher temperature, the loss of memory inherent in the nonelastomeric material prevents acceptable sealing performance at ambient temperatures. Normally, however, the self energizing Teflon elements would be initially heated to a temperature on the order of 400° F. upon insertion into a hostile environment well. Temperatures would not be expected to return to ambient conditions and the temperature cycling encountered in the majority of treating jobs would permit the use of this nonelastomeric sealing system even though it does not completely return to its initial state.

SUMMARY OF THE INVENTION

The seal system, in accordance with this invention, comprises a plurality of plastically deformable annular members which form a self-energizing dynamic seal between two concentric relatively movble tubular conduits in a subterranean well. The primary sealing elements each comprise a chevron-shaped member formed of virgin polytetrafluoroethylene, the generic name for Teflon. Several Teflon elements can be employed back-to-back to provide a relatively frictionless interface between complementary mating surfaces of the chevron-shaped virgin Teflon members. Annular back up members having a resistance to extrusion greater than that of virgin Teflon are employed to transmit axial compressive loads to the Teflon members, but to prevent axial extrusion of the virgin Teflon. These back up members include polyphenylene sulfide members and a glass-filled Teflon member. These sequentially aligned annular members comprise a single seal subassembly or array and a plurality of identical units can be employed to provide sealing integrity in opposite axial directions depending only upon the orientation of the chevron members. Metal spacers are then employed between adjacent seal assemblies.

DESCRIPTION OF THE PREFERRED EMBODIMENT

Figure 1:
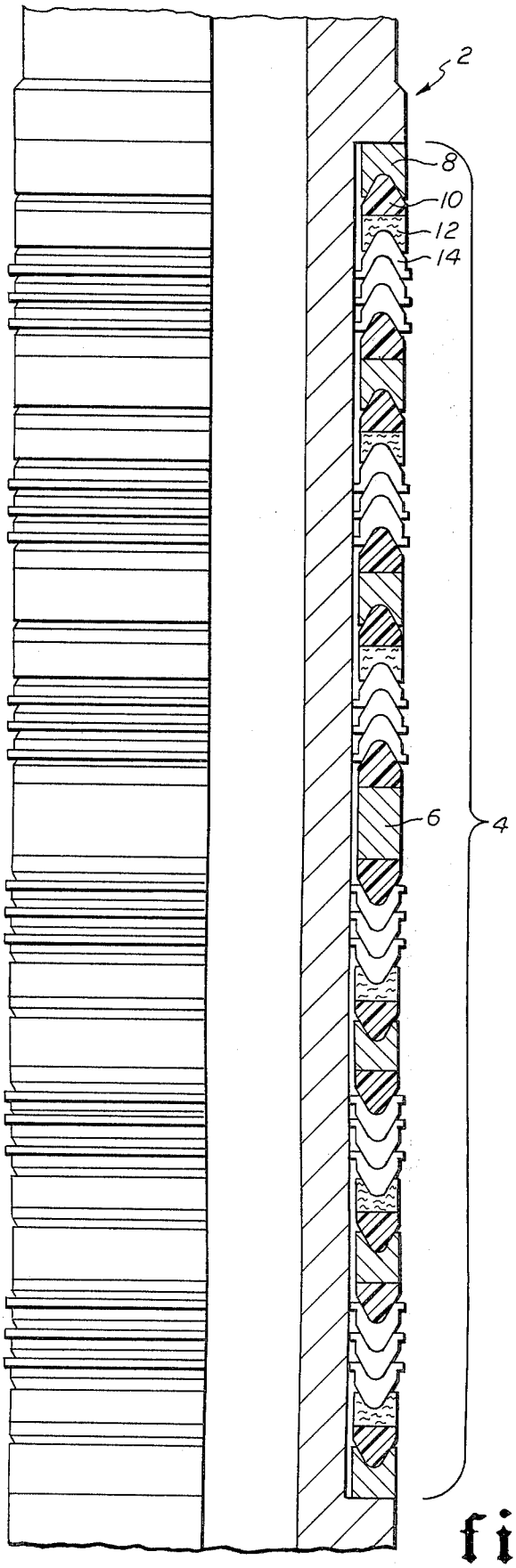
FIG. 1 shows a 3×3 seal stack configuration of the present invention and depicts this configuration in cross section and as it would appear on the exterior of a tubing member.
Figure 2:
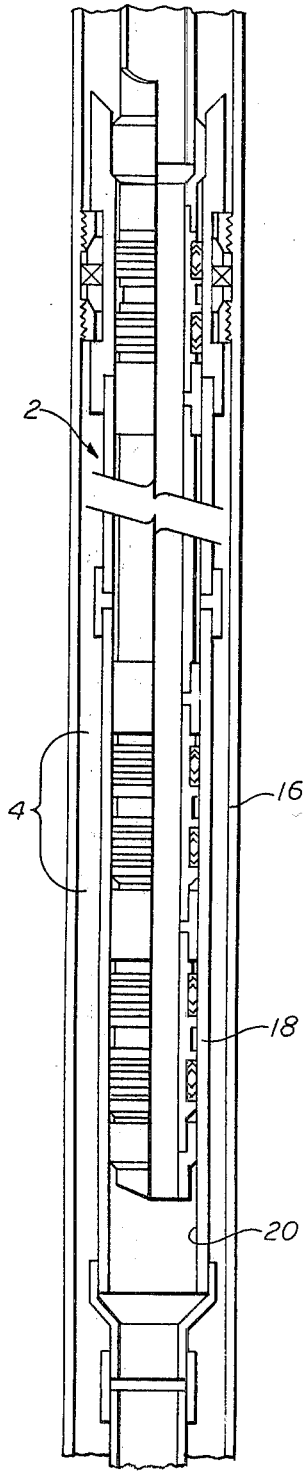
FIG. 2 depicts the seal stuck configuration of the present invention employed to form a seal between two concentric tubing members contained within an oil well casing.

In the preferred embodiment of this invention, a seal stack 4 mounted on the exterior of a tubing member 2, as shown in FIG. 1, is employed to provide sealing integrity between first and second tubing members. In FIG. 2 a first tubing member 2 and a second tubing member 18 are shown at some arbitrary location within an oil well casing 16. These inner and outer concentric tubing members are generally relatively axially movable. Not only could there be intentional movement between separate tubing members but movement can result from thermal expansion of the tubing members and other conditions encountered in normal operation. Sealing integrity must therefore be provided under dynamic conditions as well as static conditions where there is no tubing movement. A plurality of separate seal stacks 4 are shown mounted on tubing member 4. These seal stacks provide sealing integrity within the tubing string formed by members 2 and 18 and prevent communication between the tubing and the annulus between tubing member 18 and the outer casing 16.

Figure 3:
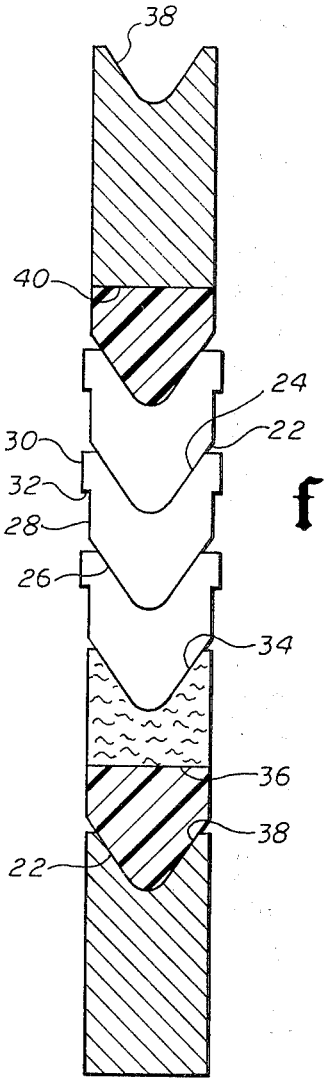
FIG. 3 is a cross-sectional view of a single seal subassembly showing metal spacers, a Ryton back up member, a glass-filled Teflon back up member, three virgin Teflon primary sealing members, and a second Ryton back up member.

As shown in FIG. 1, each seal stack system or assembly 4 comprises a plurality of individual subassemblies. FIG. 3 shows a single seal array or seal subassembly. Each subassembly comprises sequentially a metal spacer member 8, a first annular back up member 10 formed at least partially of polyphenylene sulfide (Ryton), a second back up member 12 comprising a glass-filled member of polytetrafluoroethylene (Teflon), three primary sealing elements consisting of virgin or homogeneous polytetrafluoroethylene, and a second primary back up member equivalent to the primary Ryton back up member on the opposite end of the seal subassembly. The virgin Teflon has a greater coefficient of thermal expansion than the glass-filled Teflon which, in turn, has a greater coefficient of thermal expansion than the Ryton. Each metal spacer member 8 is positioned between adjacent seal subassemblies.

Although a plurality of metal spacer members would be used in any given seal assembly, only two distinct configurations would be employed. A central metal spacer 6, having a generally rectangular cross section, is located between oppositely facing seal subassemblies. The remainder of the spacer elements 8 are positioned between seal subassemblies which are designed to face in the same direction. Annular metal spacers 6 and 8 have a radial width less than the nominal annular spacing between the concentric tubular conduits between which a seal is to be formed. Extrusion gaps thus exist between the spacers and the sealing surfaces of the conduits. Neither metal spacer 6 or 8 is expandable and neither metal spacer is itself in any way adapted to prevent extrusion through these gaps. These spacer members 8 have a concave surface 38 along one end thereof and a planar surface 40 located along the opposite end. The primary back up members 10 are located immediately adjacent to metal spacer members 8. Each primary back up member has a planar end an oppositely facing convex surface 22. These primary annular back up members are formed of polyphenylene sulfide, commonly referred to under the trademark "Ryton" owned by Phillips Petroleum Corporation. These Ryton members also contain fillers designed to give added rigidity to the Ryton member. Fillers, such as glass fibers, may be employed, but no precise composition is essential. Primary back up members 10 are located adjacent to metal spacers on opposite ends of each subassembly. The primary member 10 located at the right of the subassembly shown in FIG. 3 abuts metal spacer 8 along a planar surface 40. On the left of this individual subassembly, the Ryton back up member 10 engages metal spacer 8 along the mating convex surface 22 of Ryton member 10 and concave surface 38 of the left spacer member.

Each subassembly contains a single secondary annular back up member 12. In FIG. 3 this second back up member is shown on the left abutting the primary back up member along the planar surface 36. Secondary back up member 12 has a concave surface 34 located along its opposite face. Secondary back up member 12 comprises a polytetrafluoroethylene member, having a filler material interspersed therein. In the preferred embodiment of this invention, fibrous glass filler members are interspersed throughout the polytetrafluoroethylene to give this material a greater resistance to extrusion. In the preferred embodiment of this invention, the glass filler material in secondary annular back up member 12 may comprise about twenty-five percent of the volume of member 12.

Each subassembly contains three back-to-back primary annular sealing members 14. Each sealing member 14 has a generally chevron or Vee-shaped cross section. Members 14 have a concave mating surface 24 located along one end and a convex mating surface 26 located along the opposite end. These identical members 14 are positioned with the convex mating surface 26 contacting the complementary concave mating face 24 of the next adjacent primary sealing element. Parallel sealing faces extend between the concave and convex mating faces and consist of two side-by-side sections 28 and 30 located along the inner and outer radius of each annular member 14. The first section of each sealing face merges with the convex surface 26 of sealing member 14. A second concentric section 30 of each sealing face in turn joins the opposite concave surface 24 of each sealing member 14. A shoulder 32 extends between the first and second sections of each sealing face. Section 30 in effect comprises a raised lip on each sealing member 14. It is clear, therefore, that the thickness of raised lip 30 is less than the thickness of the sealing member 14.

The chevron cross section of each primary sealing member 14 provides a self-energizing sealing action. An axial pressure force acting on the concave surface 24 of a chevron-shaped sealing member will result in a radially induced force acting along the sealing faces of the chevron sealing member 14. Therefore, any increase in axial pressure forces will promote greater sealing integrity between the outwardly facing sealing faces and the concentric tubing members between which the annular seals extend. Any increase in temperature will also result in thermal expansion of the primary sealing members and also promote greater pressure integrity. This self-energizing action will result when either a plastic or elastomeric sealing element is employed. As used herein, an elastomeric sealing member is a member which exhibits substantially complete memory so that an elastomeric member will return to its original shape after deformation. A plastic member, such as the thermoplastic polytetrafluoroethylene, does not exhibit total elastic memory. Because of the absence of complete elastic memory in these plastic sealing members it is especially critical that axial extrusion of the primary sealing element be prevented. The primary and secondary back up members are adapted to prevent the Teflon sealing elements from extruding axially between the back up members and the surface of the tubular conduits upon which sealing integrity is to be established. Such extrusion can occur either under the action of axial pressure forces or as a result of the thermal expansion of the plastic sealing element. The primary and secondary annular back up members are characterized by greater rigidity than the primary annular sealing elements.

The primary Teflon sealing elements are subject to extrusion in both axial directions; that is, the direction from high to low pressure and also in the direction of high pressure itself. The metal spacer acts as a hydraulic ram and the plastic sealing element would have a tendency to extrude back towards the higher pressure force. This backward extrusion would be particularly prevalent with respect to sealing elements which are not subject to the pressure itself. Under normal conditions the first sealing subassembly adjacent the central metal spacer 6 would provide pressure integrity. The other sealing subassemblies, capable of providing pressure integrity in the same direction, would not be subject to any pressure force exerted along the sealing surface if the first subassembly properly holds. For example, in FIG. 1 the lowermost seal subassemblies with their upwardly facing chevrons are intended to provide pressure integrity under the action of a pressure differential exerted from above. If the first seal subassembly established a proper seal, then the lower two seal subassemblies will not be subject to the applied pressure differential at the sealing surface. Nevertheless, the pressure force acting on the spacer elements will be transmitted through spacer elements to these lowermost seal subassemblies and through the back up member to the primary annular sealing elements. These would be a tendency toward backward extrusion.

The primary and secondary back up members employed between the metal spacer elements and the virgin Teflon primary sealing members each have a greater resistance to extrusion than the polytetrafluoroethylene. The Ryton and the glass-filled Teflon members are dimensioned so that there would be a minimal tendency of the Ryton to extrude past the metal spacer and the glass-filled Teflon to extrude past the Ryton member. Both the Ryton and the glass-filled Teflon would inhibit extrusion of the virgin Teflon primary sealing elements in the axial direction.

In the preferred embodiment of this invention, the profile of the primary Teflon sealing elements is especially adapted to augment the self-energizing action of a chevron sealing member and to reduce the problems associated with inelastic, plastic memory loss in the axial direction. The lip 30 on each primary sealing member 14 will engage the surface of the inner and outer tubing conduit sealing surfaces prior to any engagement by surface 28. The axial forces transmitted in the radial direction by the chevron member will therefore be acting on lip section 30. This force will result in a greater radial pressure against the sealing surface of the tubular conduits and should provide greater sealing integrity.

Figure 4:
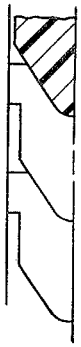
FIGS. 4, 5 and 6 are sequential views of the expansion and contraction of contiguous virgin Teflon members immediately adjacent a tubular member where a seal is established.
Figure 5:
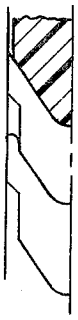
Figure 6:
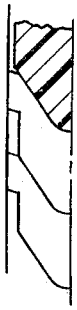

The profile of these Teflon members is also related to the use of primary sealing elements 14 positioned in back-to-back relationship with complementary concave and convex mating surfaces engaging each other, rather than the use of a single member. Since these primary sealing elements are virgin Teflon members, a relatively frictionless interface is formed between adjacent members and with the conduits with which sealing integrity must be established. FIG. 4 shows the interface between two primary sealing elements 14A and 14B. Both lips 30A and 30B are shown as they initially engage the tubular conduit sealing surfaces. As greater axial pressure is transferred to the chevron members or as radial expansion is induced by thermal exitation, the lip member 30A does tend to axially extrude along the recessed surface 28B of the adjacent sealing member 14B. This extrusion is shown in FIG. 5. As the axial pressure is reduced or as the temperature decreases, lip 30A will also contract. The presence of the relatively frictionless Teflon-to-Teflon interface will permit easier retraction than along an interface between Teflon and Ryton. The greater porosity of the Ryton back up member would result in some bonding between a Teflon member and an adjacent Ryton member when the Ryton-Teflon interface is subject to a compressive force. Back-to-back Teflon members will exhibit less adherence when subjected to pressure or other compressive force than will exist between adjacent Teflon and Ryton members. Therefore, the use of a plurality of Teflon members and the lip sections 30, as shown, will enhance both the sealing integrity of the Teflon members as well as the ability of the Teflon members to more nearly return to their original shape.

Figure 7:
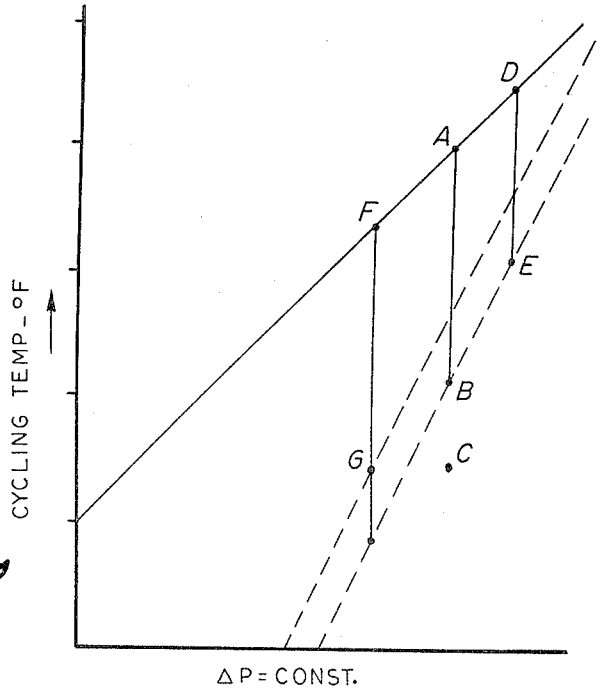
FIG. 7 shows, in a graphical format, the acceptable temperature range for which this seal system provides adequate sealing performance where a constant pressure differential is maintained across the seal assembly.

The performance of this seal system utilizing only plastically deformable sealing elements is illustrated graphically in FIG. 7. If a seal system is heated to some maximum temperature under a constant pressure differential; for example, to point A in FIG. 7, the plastically deformable seals will maintain an adequate seal at point A. If the temperature is subsequently decreased while still maintaining a constant pressure differential, it has been found that when utilizing the seal system of the present invention adequate sealing integrity will be retained at Point B. If the temperature is decreased from Point B to Point C, then sealing integrity will be lost. This loss of sealing integrity at Point C occurs even though the plastically deformable seals were originally heated from ambient temperature through Point C, through Point B, and subsequently the temperature indicated at Point A. Sealing integrity cannot be maintained below Point B because the plastic seal elements do not exhibit elastic memory. If the same seal configuration were heated to a temperature greater than the temperature corresponding to Point A, it has been found that sealing integrity cannot be maintained over the same temperature range as would be attainable with less initial heating. For example, if the temperature were increased to Point D, where the temperature is greater than the temperature at Point A, adequate sealing can only be maintained until the temperature had reached Point E. When the initial temperature rises only to that indicated at Point F, a greater temperature range (F to G) can be maintained than under the conditions A to B. Note that the uppermost boundary is defined by Points F, A and D, and Points E, B and G define the lowermost boundary. This plastically deformable sealing system is effective within these boundaries, an area which would include numerous conditions normally found in many oil wells. This lowermost boundary illustrates the inherent limitations of relying upon plastically deformable sealing elements, and the significance of improvements such as that offered by the present invention should be apparent.

Although the invention has been described in terms of the specified embodiment which is set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A self-energizing seal system consisting only of a plurality of plastically deformable nonelastomeric annular elements to form a seal between first and second concentric tubular conduits in a subterranean well when subjected to axial loads and fluctuating temperatures, said annular elements further comprising at least two adjacent primary sealing elements, each annular sealing element comprising a homogenous member of polytetrafluoroethylene having a chevron-shaped cross section with oppositely facing spaced apart convex and concave mating surfaces and an annular sealing surface extending between oppositely facing mating surfaces on each circumferential end thereof, said sealing surface having two annular sections, the first annular section adjacent said concave mating face having a greater diameter than the second section adjacent said convex surface thereby defining a lip section having a thickness less than the thickness of said annular sealing element on the outer periphery thereof, with the concave surface of a first annular sealing member contacting the complementary convex surface of the second annular sealing element to form a relatively frictionless interface along said convex surface and said second section; and a plastically deformable annular back up member having a greater resistance to extrusion than said annular sealing elements, and having a convex surface in contact with the complementary concave surface of said second annular sealing element with pressure forces acting on said annular sealing elements to induce radial expansion thereof, with axial extrusion of said second annular sealing element between said annular back up member and said concentric tubular conduits being inhibited by said annular back up member whereby sealing integrity is established along said lip section.

2. The seal system of claim 1 wherein said annular back up member comprises polyphenylene sulfide.

3. The seal system of claim 2 further comprising a plastically deformable intermediate back up member immediate the convex surface of one of said primary annular sealing elements and having a concave surface complementary with and in contact with said last mentioned convex surface.

4. The seal system of claim 3 wherein said primary annular sealing elements are formed of virgin polytetrafluoroethylene and said intermediate back up member comprises polytetrafluoroethylene with a filler material interspersed therein providing additional extrusion resistance to the polytetrafluoroethylene.

5. The seal system of claim 4 wherein said filler material comprises a glass filler of fibrous construction.

6. The seal system of claim 5 wherein a back up member comprising polyphenylene sulfide is adjacent to and in contact with said intermediate back up member.

7. A self-energizing seal system consisting only of a plurality of plastically deformable nonelastomeric annular elements to form a seal between first and second tubular conduits in a subterranean well when subjected to axial loads and fluctuating temperatures, said annular elements further comprising: a plurality of adjacent primary annular sealing elements comprising polytetrafluoroethylene and having chevron-shaped cross sections to form a contact surface between adjacent polytetrafluoroethylene elements; and plastically deformable annular back up means, on opposite sides of said adjacent primary annular sealing elements, transmitting axial loads to said primary annular sealing elements and for inhibiting axial extrusion of said primary annular sealing elements, the contact between primary annular sealing elements being along surfaces having relatively less friction than the contact surface between a primary annular sealing surface and an element comprising said annular back up means.

8. The seal system of claim 7 wherein said plastically deformable annular back up means comprises primary back up members, each comprising polyphenylene sulfide.

9. The seal system of claim 8 wherein said back up means further comprises an intermediate back up member adjacent one of said polyphenylene sulfide members, formed of polytetrafluoroethylene with a filler material interspersed therein to add resistance to extrusion to the polytetrafluoroethylene.

10. The seal system of claim 9 wherein said intermediate back up member contacts one of said primary back up members along a planar surface.

11. The seal system of claim 10 wherein said intermediate back up member has a concave surface, said concave surface being in contact with a complementary convex surface on one of said chevron-shaped primary annular sealing elements.

12. The seal system of claim 11 wherein a convex surface on one of said primary back up members is in contact with a complementary concave surface on one of said chevron-shaped primary annular sealing elements.

13. The seal system of claim 7 wherein each said primary annular sealing elements comprises a homogeneous member of virgin polytetrafluoroethylene.

14. A dyanmic sealing assembly employing plastic deformation of sealing elements to establish a seal between first and second relatively axially moveable concentric tubular conduits in a subterranean well comprising: a plurality of cylindrical plastically deformable elements axially aligned between said concentric tubular conduits, said elements further comprising at least two adjacent annular sealing members, each being a homogeneous member of virgin polytetrafluoroethylene, each sealing member having a chevron-shaped cross section with oppositely facing spaced apart convex and concave mating surfaces and sealing surfaces extending between said oppositely facing mating surfaces; the interior convex mating surfaces of the first annular sealing member being in contact with the complementary interior concave mating surface of said second annular sealing member, said adjacent annular sealing members being free to relatively slide along said complementary mating surfaces during radial plastic contraction and expansion of said annular sealing members; the sealing surfaces of said annular sealing members being free to move radially to engage said first and second concentric tubular conduits; and first and second plastically deformable annular back up members adjacent the exterior mating surfaces of said annular sealing members, said back up members having a greater resistance to extrusion than said annular sealing members, with said back up members abutting said annular sealing members to inhibit extrusion thereof in the axial direction.

15. The sealing assembly of claim 14 wherein said back up members comprise a polyphenylene sulfide member.

16. The sealing assembly of claim 15 further comprising an intermediate back up member comprising a polymer of tetrafluoroethylene with a filler material interspersed therein to increase the resistance of polytetrafluoroethylene to extrusion.

17. The sealing assembly of claim 16 wherein said filler material comprises a glass filler of fibrous construction.

18. The sealing assembly of claim 17 wherein said filler material comprises about twenty-five percent of the volume of said intermediate back up member.

19. A dynamic sealing assembly employing plastic deformation of sealing elements to establish a seal between first and second relatively axially movable concentric tubular conduits in a subterranean well comprising: a plurality of cylindrical plastically deformable elements axially aligned between said concentric tubular conduits, said elements further comprising; at least two adjacent annular sealing members, each having a chevron-shaped cross section with oppositely facing complementary spaced apart mating surfaces and sealing surfaces extending therebetween, each sealing surface comprising a first axially extending section merging with said convex mating surface and a second axially extending section extending generally concentric with said first axially extending face and spaced radially beyond said first axially extending face and being adjacent said concave mating surface, to form a raised lip having a thickness less than the thickness of said sealing surfaces between said first axially extending section and said concave mating face of a first annular sealing member, the raised lip of said first annular sealing member being free to axially expand and contract along the first axially extending surface of the second immediately adjacent annular sealing member; and to expand radially into contact with the surface of one of said concentric tubular conduits; and first and second plastically deformable back up members adjacent the exterior mating surfaces of said annular sealing members, said back up members having a greater resistance to extrusion than said annular sealing members with said back up members abutting said annular sealing members to inhibit extrusion thereof in the axial direction.

* * * * *